United States Patent [19]

Glasson

[11] 4,164,917

[45] Aug. 21, 1979

[54] CONTROLLABLE VALVE TAPPET FOR USE WITH DUAL RAMP CAM

[75] Inventor: Richard E. Glasson, Columbus, Ind.

[73] Assignee: Cummins Engine Company, Inc., Columbus, Ind.

[21] Appl. No.: 825,178

[22] Filed: Aug. 16, 1977

[51] Int. Cl.[2] ..... F02D 13/04; F01L 3/24

[52] U.S. Cl. ..... 123/97 B; 123/90.15; 123/90.16; 123/90.55; 123/90.57; 123/90.17

[58] Field of Search ..... 123/97 B, 90.15, 90.16, 123/90.17, 90.48, 90.55, 90.56, 90.57, 90.58, 90.12

[56] References Cited

U.S. PATENT DOCUMENTS

| | | | |
|---|---|---|---|
| 3,367,312 | 2/1968 | Jonsson | 123/97 B |
| 3,405,699 | 10/1968 | Laas | 123/97 B |
| 3,547,087 | 12/1970 | Siegler | 123/90.16 |
| 3,572,300 | 3/1971 | Stager et al. | 123/97 B |
| 3,650,251 | 3/1972 | Pelizzoni | 123/90.57 |
| 3,786,792 | 1/1974 | Pelizzoni et al. | 123/97 B |

*Primary Examiner*—Charles J. Myhre
*Assistant Examiner*—Jeffrey L. Yates
*Attorney, Agent, or Firm*—Sixbey, Friedman & Leedom

[57] ABSTRACT

A hydraulic tappet or lash adjuster of simplified design is disclosed for use in the valve train of an internal combustion engine equipped with dual ramp cams. In one embodiment, the disclosed tappet is designed to respond to the presence or absence of control pressure supplied through a single supply port to cause variation in the timed relationship of valve opening and piston movement whereby the internal combustion engine may be operated in a power mode or a braking mode. In another embodiment, a pressure relief outlet is provided in the tappet for cooperation with a pressure relief port to insure collapse of the tappet thereby to prevent the valve from being opened beyond a pre-determined fully open position.

9 Claims, 14 Drawing Figures

FIG. 4
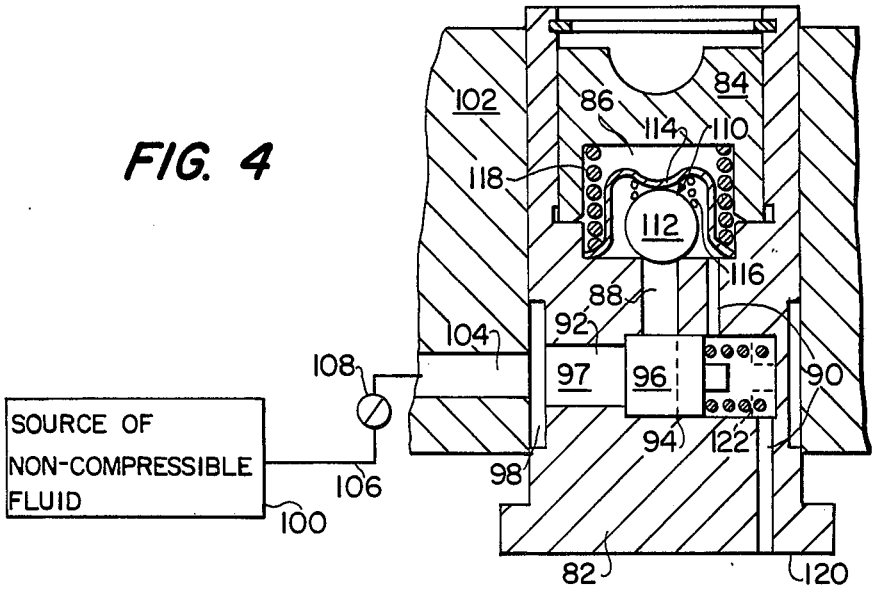
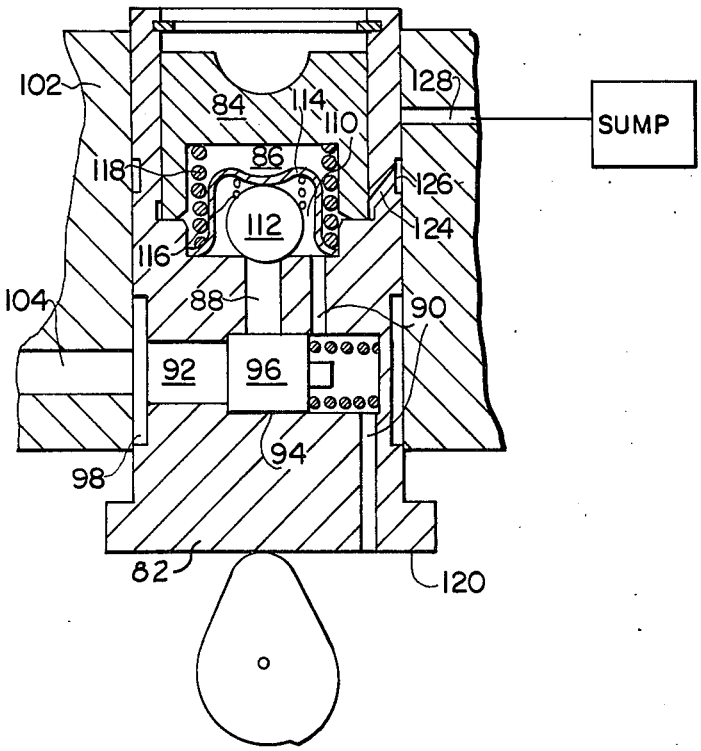
FIG. 5

CONTROLLABLE VALVE TAPPET FOR USE WITH DUAL RAMP CAM

BACKGROUND OF THE INVENTION

The use of hydraulic tappets or lash adjusters in the valve train of internal combustion engines is well known. Generally, the function of such tappets is to reduce engine noise due to the looseness associated with various mechanical components of the engine valve train and, also, to eliminate valve tapping that develops as the various parts of the valve train wear in use. Valve tappets are located between the valve rocker arm and the push rod for the valve rocker arm, if the engine is a valve-in-head type, or between the cam shaft and the end of the valve stem, if the engine is the so called "flat head" type. The former arrangement is disclosed in U.S. Pat. No. 3,786,792, while the latter type engine is illustrated in U.S. Pat. No. 2,614,547. Essentially, the valve tappet is comprised of an open-ended cylindrical cup and a plunger telescopically engaging the interior of the cylindrical cup to form a tappet chamber to receive a fluid, usually lubricating oil from the engine's lubrication system. The cup and plunger can move axially relative to one another so that, when the lubricating oil under pressure is admitted into the chamber, the tappet elongates axially and thus causes the slack in the valve train to be eliminated. The oil generally enters the tappet chamber from a suitable port provided for this purpose in the engine block layout passing therein through a spring operated, one-way check valve which blocks the flow of oil out of the tappet chamber, which then remains full, assuming there is no oil seepage from the chamber either past the check valve or from between the opposed telescoped parts.

In recent years, there has been considerable development work done to utilize the internal combustion engine in over the road vehicles not only as a power source for vehicles, but also as a brake to supplement the usual vehicle wheel braking system. Basically, engine braking may occur in either of two ways, that is, "suction" braking or "compression" braking. "Suction" braking inherently occurs in a carburetor type engine equipped with a throttle valve in the intake system whenever the throttle is fully closed because the entire intake system operates at a negative pressure. However, the amount of "suction" braking thus derived is limited by the pressure difference that can be drawn across the closed throttle valve. Obviously, this pressure could never exceed one atmosphere and thus "suction" braking may not be sufficient to provide effective engine "braking" where the engine is used to power a large vehicle. Moreover, those vehicles equipped with engines which have no throttle valve in the intake system as described above, such as a fuel injected or compression ignition engine (e.g., a diesel engine) do not experience an inherent "braking" effect when the operator releases the accelerator pedal because a throttle valve of the type described above is totally lacking. In circumstances where inherent "vacuum" braking is insufficient or non-existent, a different type of engine braking, termed "compression" braking, has been employed which involves the steps of maximizing the intake of air (without admixture of fuel) during the intake stroke, compressing this air during the compression stroke and releasing the compressed air at the end of the compression stroke. To realize the greatest possible engine compression braking, it is essential that the maximum volume of air be drawn into the engine cylinders for compression as the pistons come up on the compression stroke and that this compressed volume be released at the beginning of the expansion stroke.

Engines equipped with throttles in the intake system can be modified to accommodate compression braking as described by using an auxiliary valve in the intake system that would allow air to by-pass the carburetor when in the braking mode, thus preventing introduction of fuel into the cylinders during braking. In a fuel injection or compression ignition engine normal engine operation prevents introduction of fuel during the braking mode; therefore, no auxiliary valve is required. In both throttle equipped engines and in fuel injected or compression ignition engines, the exhaust and intake valves are normally held closed during the last portion of the compression stroke and the beginning of the expansion (firing) strokes when such engines are operated in the power mode. Thus the normal opening and closing of the valves during the power cycle in the operation of an internal combustion engine is at variance with that required should it be desired to operate the engine to effect "compression" braking. The net result is that either the cylinders must be provided with multiple intake and exhaust valves operated by individual selectively operable cam shafts, one such valve system being designed for normal engine operation, the other system being designed to provide engine braking, or, alternatively, and preferably, some mechanism should be provided to operate the usual intake and exhaust valves in one mode for normal (power) engine operation and another mode for engine braking. The obvious benefit of such dual mode operation of the valves is the elimination of the cost and complication of duplicate valve systems or trains.

One method of providing for dual mode operation of the valves is by means of what is known as a dual ramp camshaft, such as illustrated in U.S. Pat. No. 3,786,792, wherein the valve train for each exhaust valve is provided with a cam having a secondary base circle (recessed below the radius of the valve closing, primary base circle) for engaging the valve train during the intake and compression strokes of the associated piston and a hydraulically adjustable tappet selectively operable to cause the exhaust valve to partially open during the expansion stroke of the piston. More particularly the adjustable tappet is spring biased to extend when the valve train is in contact with the secondary base circle of the cam and normally to collapse when the train is in contact with the primary base circle except when hydraulically locked in the extended condition to cause partial opening of the exhaust valve during the expansion stroke as described fully in U.S. Pat. No. 3,786,792. This is a very practical and reasonable approach because the valve train mechanism is not substantially changed from the conventional configuration; there is no expensive duplication of parts; and it is a fairly straightforward uncomplicated matter to provide the hydraulic circuit necessary to selectively lock the adjustable tappet in the extended position. However, in some engine environments the provision of a dual ramp camshaft gives rise to complications especially with regard to valve and piston clearance. For example piston clearance is particularly acute in the case of diesel engines of the overhead valve configuration because the high compression required to cause compression ignition of the diesel fuel in the fuel-air charge, generally on the order of 17 to 1, requires that the piston move very close to the top of the cylinder at its top dead center position. In fact, in most diesel engines, when the piston is in the top dead center position its top face is so close to the cylinder head that, in valve-in-head engines, the valves must be closed to avoid being struck by the piston. Since during the power mode operation of an engine the valves are closed in all cases where the piston reaches top dead center the clearance between pistons and valves is perfectly satisfactory. However, when such an engine is operated in the braking mode the valve timing is changed thereby increasing the possibility that the valves may strike the piston when the piston comes up to top dead center. This problem is of particular concern when the adjustable tappet is continually locked in the elongated condition during the "braking" mode as in the case with the prior art dual ramp cam and tappet arrangement described above since the exhaust valve is raised above its normal fully open position.

In addition to the clearance problem, prior art systems employing hydraulically operated tappets have tended to be complicated, expensive and difficult to retro-fit in an engine. In particular, designs are known for bleeding small amounts of fluid from the tappet chamber of a hydraulic tappet upon preselected displacement of the tappet such as illustrated in U.S. Pat. No. 3,650,251 and designs are known to hydraulically limit the maximum opening displacement of a valve in an engine braking system such as illustrated in U.S. Pat. No. 3,405,699. However, such systems have failed to incorporate the advantages of a dual ramp cam configuration. Moreover, these systems certainly have not suggested a technique for insuring valve clearance while also simplifying the basic hydraulically adjustable tappet designs known heretofor for use with dual ramp cams.

OBJECTS OF THE INVENTION

The present invention, then, is directed to a valve train arrangement for use with dual ramp camshafts for engine braking wherein the novel valve tappet arrangement prevents the engine piston from striking the intake and exhaust valves when operating in an engine braking mode.

Another purpose of the invention is to provide for a unique and simplified two part valve tappet for an internal combustion engine.

An additional object of the invention is to provide a relatively simple but reliable method for operating a valve tappet.

Still another object of the invention is to provide a valve opening apparatus for limiting the fully opened position of a valve in an internal combustion engine having at least one reciprocating piston associated with the valve and operable in selectively variable timed relationship with the valve by means of a valve train connected with a rotable cam having circumferential portions successively engaging the valve train including a primary base circle for causing valve closure, a raised portion for causing valve opening and a secondary base circle recessed below the primary base circle. This object is obtained by providing control apparatus including an extensible thrust conveying means installed within the valve train for transmitting opening and closing movement from the cam to the valve and for varying the timed relationship of the valve and piston operation by varying the effective length of the valve train and by providing control means for selectively operating the extensible valve conveying means in a first or second mode thereby controlling the instant at which the extensible thrust conveying means collapses during each revolution of the cam. This arrangement permits the valve to be selectively opened when the valve train is engaged by the primary base circle of the rotating cam without increasing the valve lift caused by the raised portion of the rotating cam to thereby insure proper valve piston clearance.

Yet another object of this invention is to provide a control apparatus as set forth above further including a position sensing means for sensing a predetermined upper displacement of the valve train and for causing said extensible thrust conveying means to collapse during the second mode of operation whenever the valve train attains this predetermined upper displacement.

The above noted objects of the invention not specifically referred to, but, nevertheless readily apparent to those skilled in the art, may be accomplished by providing an internal combustion engine with a valve train including a plurality of valve tappets or lifters, each said tappet including a pair of cylindrical or telescopic thrust members having a chamber defined therebetween. One of said thrust members is in engagement with the engine cam shaft, the other said thrust members is in engagement with a valve operating means, i.e. a push rod or the like, said first mentioned thrust member having a passage in communication with said chamber and a source of oil under pressure. A one-way check valve in said chamber is also provided permitting the flow of fluid, such as lubricating oil, into the chamber but preventing the reverse flow of oil out of the chamber. Included in the tappet is a pressure operated plunger means for permitting flow out of the chamber when in one position and for preventing flow out of the chamber when in a second position and further a pressure relief passage in communication with said chamber and carried in one of said thrust members and movable therewith to a position in communication with the vent port whereby fluid in said chamber may be vented therefrom when said last passage is in communication with said vent port.

Having thus described the invention broadly a preferred mode of effecting the concepts involved will be apparent from the following detailed description of the preferred embodiment in association with the drawings attached hereinto.

DETAILED DESCRIPTION OF THE DRAWINGS

Figure 1:
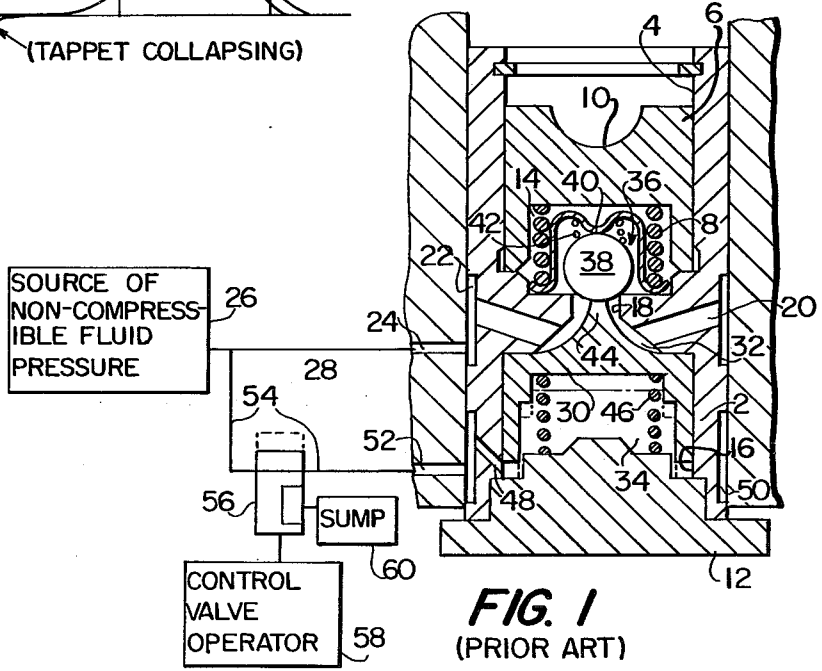
FIG. 1 (PRIOR ART)
Figure 2:
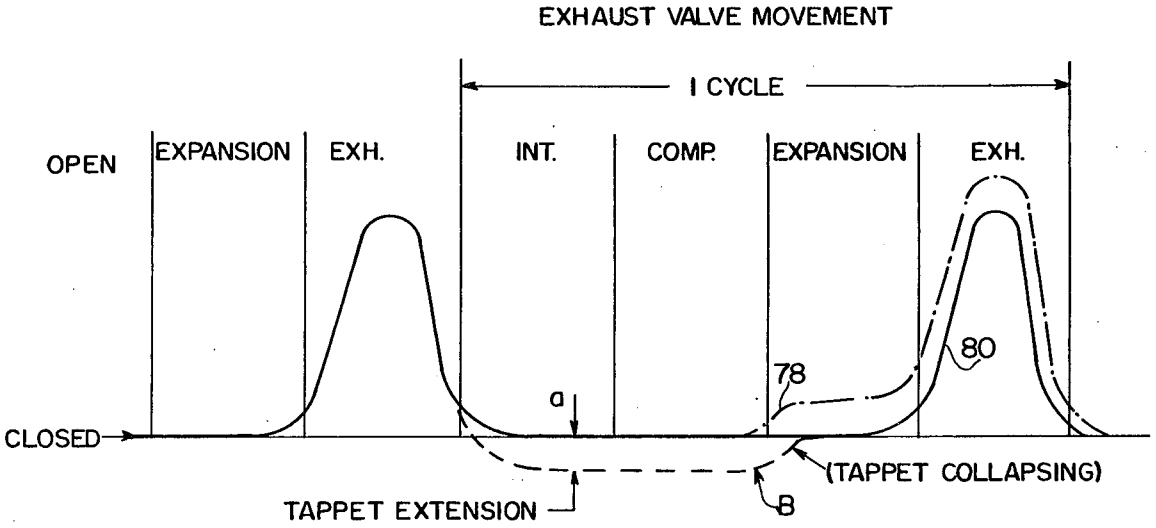
FIG. 2 (PRIOR ART)
Figure 3:
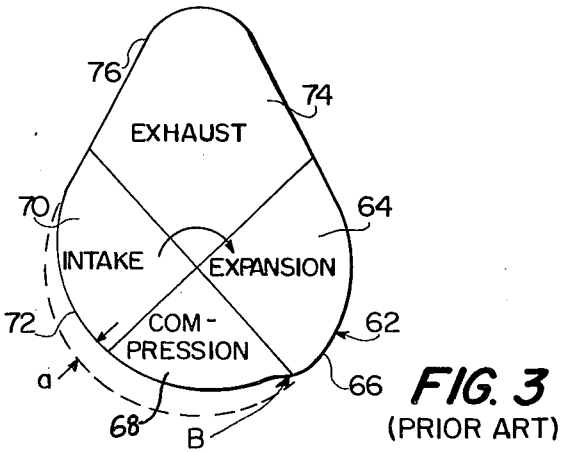
FIG. 3 (PRIOR ART)
Figure 6:
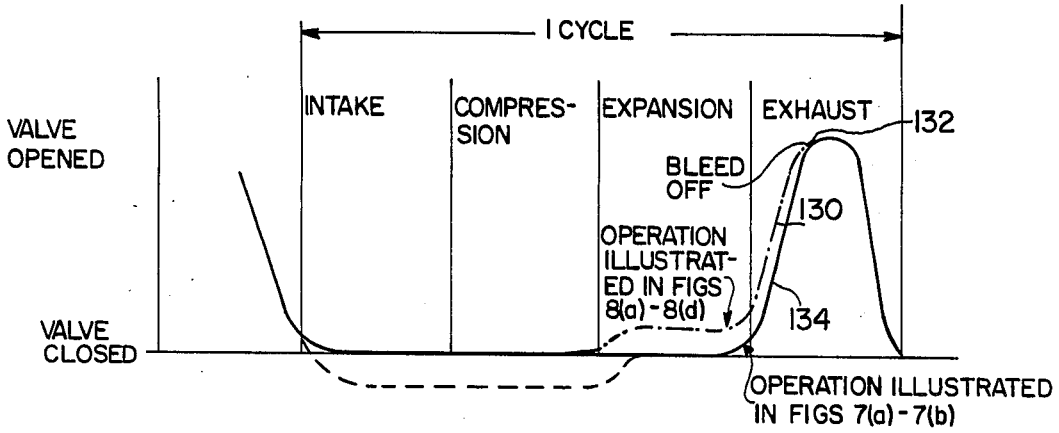
Figure 7A:
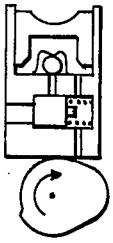
Figure 7B:
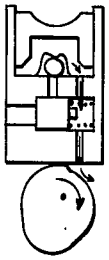
Figure 7C:
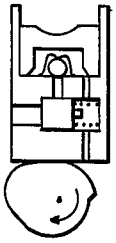
Figure 7D:
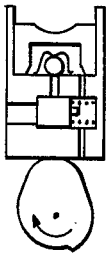
Figure 8A:
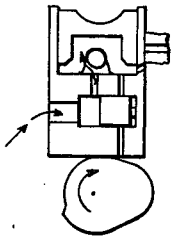
Figure 8B:
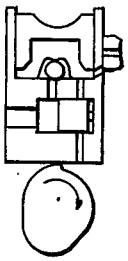
Figure 8C:
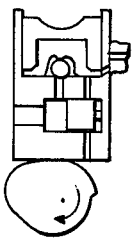
Figure 8D:
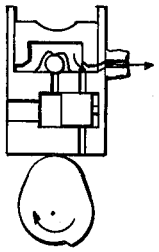

FIG. 1 is a cross sectional view of an adjustable tappet which is selectively lockable in an extended position in response to a fluid pressure control signal, FIG. 2 is a graphic illustration of the movement of the valve train including the tappet of FIG. 1 when operated by a dual ramp cam such as employed in the prior art, FIG. 3 is a side elevational view of a prior art dual ramp cam, FIG. 4 is a cross-sectional view of a hydraulically operated tappet according to the subject invention including a check valve combined with a pressure operated plunger valve for selectively locking the tappet in an extended position, FIG. 5 is a cross-sectional view of a second embodiment of the subject invention in which the tappet is designed to automatically collapse when displaced to a predetermined upper position, FIG. 6 is a graphic illustration of the displacement of an intake valve in a four cycle, internal combustion engine equiped with a dual ramp cam and an adjustable hydraulically operable tappet of the type illustrated in FIG. 5, FIGS. 7(*a*) through 7(*d*) illustrate the condition of the adjustable tappet during each quarter turn of the dual ramp cam corresponding to the respective piston strokes illustrated in FIG. 6 when the plunger valve of the tappet is in the unactuated position, and FIGS. 8(*a*) through 8(*d*) are illustrations of the condition of the adjustable tappet during each quarter turn of the dual ramp cam corresponding to the respective strokes of an associated piston as illustrated in FIG. 6 when the plunger valve is actuated by fluid pressure.

DESCRIPTION OF THE PREFERRED EMBODIMENTS

In order to permit a thorough explanation of the subject invention, the operation of prior art adjustable, hydraulically operated tappets will be discussed with reference to FIGS. 1 through 3. In particular reference is made to FIG. 1 which discloses a hydraulically operated tappet of the type illustrated in U.S. Pat. No. 3,786,792 for use in a valve train of a four cycle, internal combustion engine equipped with dual ramp cams of the type illustrated in FIG. 3. Tappets of this type include a lower thrust member 2 containing an open ended, recessed cavity 4 formed in the upper portion for receiving a telescopically engaged upper thrust member 6 such that the effective length of the tappet can be varied upon telescopic movement of the upper and lower thrust members.

As illustrated in FIG. 1, the thrust members are biased apart by a spring 8 such that one member may be biased toward the portion of the valve train which actually engages the valve and the other thrust member is biased toward the dual ramp cam. In the specific embodiment of FIG. 1, the upper surface of the upper thrust member contains a semi-spherical recess 10 for receiving the spherical end portion of a valve push rod which is normally found in a valve-in-head internal combustion engine. The lower end of the lower thrust member 2 includes a cam engaging surface 12 which is adapted to bear against the cam surface of the rotating dual ramp cam to be described more fully hereinbelow. The upper and lower telescopically engaged thrust members, 2 and 6, are configured, as illustrated in FIG. 1, to form a variable volume chamber 14. The lower thrust member also includes an interior cavity 16 communicating with the variable volume chamber through a centrally located, vertically oriented passage 18. Interior cavity 16 in turn communicates with the exterior of the lower thrust member by means of a plurality of transfer passages 20, each of which opens into an exterior annular recess 22 formed on the exterior surface of the lower thrust member 2. The annular recess 22 is positioned on the lower thrust member 2 so as to be in continual communication with a pressure supply port 24 which in turn is supplied with non-compressible fluid from source 26 through conduit 28.

A slidable piston 30 is provided within interior cavity 16 so as to divide the interior cavity into an upper chamber 32 and a lower chamber 34. Non-compressible fluid under pressure is normally supplied to the upper chamber 32 from the pressure source 26 through conduit 28, the pressure supply port 24, the annular recess 22, and the transverse passage 20. Located within the variable volume chamber 14 is a check valve 36 which, in this case, consists of a ball 38 retained generally over the passage 18 by means of a retainer 40 and biased toward the passage 18 by means of a spring 42. Normally non-compressible fluid under pressure, such as the lubricating oil of an internal combustion engine, is supplied from the upper chamber 32 into the variable volume chamber 14 whenever chamber 14 tends to increase in volume. However, should the upper and lower thrust members tend to collapse, the oil within chamber 14 would tend to close check valve 36 thereby preventing collapse of the tappet. In order to permit collapse of the tappet, an upstanding projection 44 is provided on the upper surface of the slidable piston 30 which is adapted to project through passage 18 so as to hold ball 38 away from the passage closing position thereby permitting the non-compressible fluid to flow back out of chamber 14 and allow collapse of the thrust members as illustrated in FIG. 1 wherein piston 30 is shown in its uppermost position.

Piston 30 is biased toward its upper most position by spring 46 but may be pushed downwardly to permit normal operation of check valve 38 whenever the pressure within the upper chamber 32 is sufficient to overcome the bias on piston 30. The pressure from source 26 is designed to overcome this spring pressure. However, the lower chamber 34 may be selectively provided with oil under pressure from source 26 by means of lower transverse passage 48, annular recess 50, auxiliary pressure supply port 52 and auxiliary conduit 54 in communication with conduit 28. A control valve 56 and control valve operator 58 are further provided to selectively connect auxiliary supply port 52 to conduit 28 or to sump 60 dependent upon whether it is desired to inactivate check valve 36, as illustrated in FIG. 1, or to permit the check valve to prevent fluid from flowing out of the variable volume chamber 14.

When installed in the valve train of a four cycle, internal combustion engine having a dual ramp cam, the adjustable tappet, illustrated in FIG. 1 may be employed to vary the timed relationship between the movement of an associated piston and valve operated by the valve train to thereby achieve selectable engine operational characteristics. For example, the adjustable tappet FIG. 1 may be employed to permit operation of a four cycle internal combustion engine in either a power mode or a braking mode dependent upon the activation or deactivation of the check valve 36 as can be understood more clearly by reference to FIGS. 2 and 3.

In FIG. 2 the movement of an exhaust valve is illustrated when operated by a valve train equipped with the tappet illustrated in FIG. 1. In particular, the exhaust valve remains closed during the intake and compression strokes to permit the cylinder to receive a full charge of fluid but is selectively opened during the normal expansion stroke to permit the energy stored during the compression stroke to be selectively released thereby preventing not only power from being derived due to ignition of the charge but also preventing the energy stored during compression from being returned to the piston during the expansion stroke. Operation in this "braking" mode can be better understood by reference to FIG. 3 wherein a dual ramp cam 62 is illustrated showing those portions of a cam which engage the exhaust valve train during the respective intake, compression, expansion, and exhaust strokes of the associated piston. In particular quadrant 64, which engages the valve train during the expansion stroke, includes a primary base circle surface 66 having a radius of curvature spaced from the center of rotation of cam 62 by a distance which is just sufficient to permit closure of the exhaust valve when the respective thrust members are fully collapsed as illustrated in FIG. 1. Quadrants 68 and 70 include a surface comprising a secondary base circle 72 for engaging the cam engaging surface 12 of the tappet illustrated in FIG. 1 during the intake and compression strokes of the associated piston. The secondary base circle 72 has a radius which is less than the radius of the primary base circle 66 and therefore causes the lower thrust member 2 to move below a level necessary for fully closing the exhaust valve. In a normal valve train a significant lash or play would result. However, with the provision of the telescopic thrust members biased apart by spring 8, the tappet is merely caused to expand thereby increasing the volume of chamber 14 and causing oil from source 26 to flow into chamber 14. Quadrant 74 includes a raised surface 76 for engaging the cam engaging surface 12 during the exhaust stroke of the associated piston. Obviously the significant projection of surface 76 beyond the radius of the primary base circle is sufficient to cause the exhaust valve to open whether the valve tappet of FIG. 1 is expanded or fully collapsed.

In operation, the cam of FIG. 3 is caused to rotate in a clockwise direction such that upon movement of the contact point between the cam and the cam engaging surface 12 from quadrant 74 to quadrant 70, the thrust members 2 and 6 are caused to expand since the secondary base circle has a radius below the radius necessary to allow the exhaust valve to fully close. Thus, the volume in chamber 14 increases and an equal volume of oil enters the chamber through check valve 36. Assuming piston 30 is in the position illustrated in FIG. 1, the thrust members are caused to collapse to their fully collapsed position as the point of engagement between the cam and the cam engaging surface 12 moves from quadrant 68 to quadrant 64. The exhaust valve continues to remain closed, however, since the primary base circle 66 is, by definition, slightly below the radius necessary to cause the exhaust valve to remain closed. Should it be desired to operate the engine in a braking mode, valve 56 may be moved to the position illustrated in dashed lines in which auxiliary port 52 is caused to communicate with sump 60 thereby removing pressure from lower chamber 34 and permitting the oil pressure within upper chamber 32 to overcome the bias of spring 46 and displace piston 30 downwardly thereby activating check valve 36. Upon the next cycle of cam 62, the thrust members expand as discussed above when cam engaging surface 12 is in contact with quadrants 68 and 70 but remain in the expanded condition when the point of contact moves from quadrant 68 to quadrant 64 thus the exhaust valve is partially opened as illustrated in the dot/dashed line 78 of FIG. 2.

It should, therefore, be clear that the valve movement will follow the path schematically illustrated in FIG. 2 by the dot/dashed line 78 or the solid line 80 dependent on whether the valve 56 is in the position illustrated in FIG. 1 in which the engine would operate in a normal power mode or in the position illustrated in dashed lines to cause the engine to operate in a braking mode.

Turning now to the subject invention, attention is directed to FIG. 4 wherein a tappet is illustrated when designed in accordance with the subject invention. As is apparent piston 30 of FIG. 1 has been eliminated along with auxiliary port 52 but without eliminating the function performed by such structure as will be described hereinbelow. In particular, the adjustable tappet illustrated in FIG. 4 includes a lower thrust member 82, having a recessed cavity for receiving an upper thrust member 84 telescopically received within the recessed cavity so as to form a variable volume chamber 86. The lower thrust member 82 contains a fluid inlet 88 and a fluid outlet 90 communicating with the variable volume chamber 86. A transverse passageway 92, also contained within the lower thrust member 82, is provided intersecting the fluid outlet 90 and communicating with the fluid inlet 88. The transverse passageway 92 includes an enlarged section 94 for slidingly receiving a plunger valve 96 and a port section 97 communicating with an annular recess 98 contained on the outer surface of the thrust number 82. The annular recess 98 is positioned on the outer surface of the lower thrust member 82 so as to continually communicate with a fluid supply port 104 contained within the internal combustion engine which is, in turn, supplied by a source of non-compressible fluid 100. Lower thrust member 82 is adapted to slide axially within the stationary structure of the internal combustion engine such as a portion 102 of the engine block which contains the fluid supply port 104 to which fluid under pressure is supplied through conduit 106 connected at one end to source 100. The fluid conduit 106 is selectively closeable by valve 108 in order to determine the mode of operation of the tappet to be described more fully hereinbelow. A check valve 110, similar in construction and operation to the check valve of FIG. 1, is provided within the variable volume chamber 86 so as to permit one-way fluid flow through fluid inlet 88. However, due to the absence of any mechanical de-activating mechanism, the check valve 110 prevents reverse fluid flow within fluid inlet 88 at all times. The check valve 110 includes a ball 112, a ball retainer 114 and a biasing spring 116 adapted to bias the ball 112 against the opening of fluid inlet 88. Also provided within variable volume chamber 86 is a spring 118 for causing expansion of the thrust members 82 and 84 whenever the cam engaging surface 120 of the lower thrust member engages the secondary base circle of the dual ramp cam provided in the internal combustion engine for operating the valve train in which the tappet of FIG. 4 is installed.

As illustrated in FIG. 4, upper and lower thrust members 82 and 84 form an extensible thrust conveying means installable within a valve train of an internal combustion engine provided with a dual ramp cam for operating the valve train. The extensible thrust conveying means is adapted to convey opening and closing movement from the dual ramp cam to the valve wherein the collapsed length of the thrust conveying means is selected to be sufficiently short to permit closing of the valve when the primary base circle of the dual ramp cam engages the valve train but is sufficiently long to permit full opening of the valve when the outermost raised portion of the dual ramp cam engages the valve train. Plunger valve 96 is operable to provide control valve means movable between a first position, illustrated in full lines in FIG. 4, in which fluid is prevented from flowing into the variable volume chamber through the fluid inlet 88, but is permitted to flow out of the variable volume chamber 86 through the fluid outlet 90 and the intersecting portion of the transverse passageway 92. When in this configuration, the upper and lower thrust members 82 and 84 can expand and collapse during the power mode of operation of the dual ramp cam at the same points of the cam rotation as described with reference to the prior art tappet of FIG. 1. Moreover, the control valve means of FIG. 4 including transverse passageway 92, annular recess 98, fluid conduit 106, fluid source 100, and a valve 108 provides a significantly simplified structure for switching the valve tappet embodiment of FIG. 4 to a second mode of operation, whereby fluid is provided under pressure to cause the slidable plunger valve 96 to move to a second position illustrated in dotted lines 122 in which the fluid inlet 88 is open to allow fluid flow into the variable volume chamber 86 through the check valve 110 and the fluid outlet 90 is blocked to prevent fluid flow out of the variable volume chamber. In this second mode, the thrust members extend and are held in the extended position resulting in partial opening of the associated valve to thereby permit exhaust of the compressed fluid charge drawn into the piston cylinder during the intake stroke. Operation of the tappet in this mode thereby converts the piston from a power producing to a power absorbing function to convert the engine from a power source to a power absorbing pump which may be used to brake a vehicle in which the engine is utilized. The tappet of FIG. 4 is, thus, capable of performing the same overall function as the prior art structure illustrated and described with reference to FIGS. 1 through 3, but is significantly less complicated by virtue of the elimination of the auxiliary supply port and the need for mechanically interfering with the operation of a check valve within the variable volume chamber.

Reference is now made to FIG. 5 wherein a second embodiment of the subject invention is illustrated in which those parts identical to corresponding parts in FIG. 4 have been assigned the same reference numeral. The basic difference in the embodiment of FIG. 5 over that of FIG. 4 is the provision of a pressure relief outlet 124 contained within lower thrust member 82 and communicating between the variable volume chamber 86 and an annular recess 126 on the outer surface of the lower thrust member 82. The annular recess 126 is positioned to communicate with a pressure relief port 128 contained within the internal combustion engine whenever the valve associated with the valve train in which the tappet of FIG. 5 is installed has reached its fully open position. The pressure relief port communicates with a non-compressible fluid sump such as the crank case reservoir for holding the engine lubricating oil such that upon the lower thrust member 82 attaining this predetermined position, in which annular recess 126 communicates with pressure relief port 128, the fluid within the variable volume chamber 86 is caused to be expelled causing the thrust members 82 and 84 to move to the fully collapsed position.

The modification illustrated in FIG. 5 permits a very significant and important improvement over the operation of the prior art tappet illustrated and described with reference to FIGS. 1 through 3 by virtue of permitting the selective partial opening of a valve during one portion of the rotation of a dual ramp cam while limiting the valve to an upper displacement no greater the predetermined open position during all modes of operating the tappet. This ability to limit the fully open position of the valve is particularly useful within a diesel engine wherein the maintenance of valve clearance from the piston becomes extremely difficult to achieve since the exhaust and intake valves are no longer fully closed at all times when the piston is at top dead center. The embodiment of FIG. 5 helps to eliminate this problem by establishing an upper displacement limit beyond which the valve train is not permitted to move the valve regardless of the mode of operation of the engine. To understand this function more thoroughly, reference is made to FIGS. 6 through 8 wherein the condition of the tappet during the "power" mode of operation of the exhaust valve is illustrated in FIGS. 7(*a*) through 7(*d*) for each of the four strokes of an associated piston and the condition of the tappet during the "braking" mode of operation of the exhaust valve for each of the four strokes of an associated piston are illustrated in FIGS. 8(*a*) through 8(*d*). In particular, the normal power mode of operation results when control fluid pressure is no longer provided to the fluid supply port 104, thereby causing the plunger valve 96 to be biased into its first position as illustrated in FIGS. 7(*a*) through 7(*d*) such that the thrust members expand during the intake and compression strokes, FIGS. 7(*a*) and FIG. 7(*b*), but collapse immediately at the beginning of the expansion stroke, FIG. 7(*c*), so as to permit firing of the compressed charge within the cylinder followed by a normal opening of the exhaust valve while the tappet is fully collapsed, FIGS. 7(*d*).

In FIGS. 8(*a*) through 8(*d*), the plunger valve 96 has been moved to a second position in which the fluid inlet 88 has been opened and fluid outlet 90 closed so as to permit oil to enter the variable volume chamber 86 during expansion of the thrust members normally occuring during the intake stroke, FIG. 8(*a*), which condition continues during the compression stroke 8(*b*). At the beginning of the expansion stroke, pressure within the variable volume container increases due to successive engagement of the lower thrust member by the secondary base circle and the primary base circle of the cam. However, the check valve permits reverse flow through the fluid inlet and prevents flow of fluid through the fluid outlet to thereby cause the fluid within the variable volume chamber to be retained throughout the entire expansion stoke of the piston, FIG. 8(*c*). The result is that the exhaust valve is partially open as shown by the dot/dash line 130 in FIG. 6. This condition continues even during a portion of the exhaust stroke until the tappet reaches a predetermined upper limit whereat the annular recess 126 communicates with the pressure relief port 128 causing the oil within the variable volume chamber to be bled off as indicated at point 132 in FIG. 6. This point is made to coincide with the upper limit of valve travel caused by the condition of the valve tappet illustrated in FIG. 7(*d*) and illustrated by the crest of solid line 134 in FIG. 6.

Of course the valve tappet embodiment of FIG. 5 may be employed in the valve train of any cam operated valve wherein the cam is provided with a dual ramp having a secondary base circle recessed below the radius of a primary base circle which, in turn, has a radius just sufficiently short to permit closing of the valve. Selective supply of fluid to the transverse passageway 92 will cause the valve to lock in an extended condition until the pressure relief outlet and the pressure relief port communicate at the upper most desired limit of displacement of the tappet. It is necessary, of course, to form the pressure relief outlet 126 and the pressure relief port 128 with a sufficient diameter so as to permit all of the excess non-compressible fluid contained within the expanded variable chamber 86 to be completely expelled almost instanteously thereby to prevent displacement of the upper thrust member in the valve tappet beyond the desired predetermined limit.

When a valve tappet, such as illustrated in FIG. 4, is provided in a dual ramp cam operated valve train, the timed relationship of the valve with respect to the movement of the piston may be varied at will to achieve the desired mode of operation. As has been described above, this useful function is achieved with an extremely simple design having fewer moving parts as well as fewer parts which must mechanically interact. Moreover, this simple tappet design may be further provided with the feature illustrated in FIG. 5 for limiting the fully opened position of a valve regardless of the mode in which the tappet is operating. The subject invention thus achieves improved design and improved result over hydraulic tappet design known heretofor.

I claim:

1. Valve opening control apparatus for limiting the fully open position of a valve in an internal combustion engine having at least one reciprocating piston and an associated valve operable in selectively variable timed relationship with the piston by means of a valve train connected with a rotatable cam having circumferential portions successively engaging the valve train including a primary base circle for causing valve closure, a raised portion for causing valve opening to a predetermined upper limit and a secondary base circle recessed below the primary base circle, said control apparatus comprising (a) extensible thrust conveying means installable within the valve train for transmitting opening and closing movement from the cam to the valve and for varying the timed relationship of valve and piston operation by varying the effective length of the valve train;

(b) control means for selectively operating said extensible thrust conveying means either in a first mode in which said thrust conveying means extends in length when the valve train is engaged by the secondary base circle of the cam and collapses during each revolution of the cam as the point of engagement of the cam with the valve train shifts from the secondary base circle to the primary base circle or in a second mode in which said extensible thrust conveying means is extended in length when the valve train engages the secondary base circle of the cam and is locked in an extended position of sufficient length to cause partial opening of the valve when the valve train is engaged by the primary base circle of the cam and in which said extensible thrust conveying means is unlocked and collapsed completely during each revolution of the cam before the valve train engages the outermost raised portion of the cam, said control means includes a position sensing means for sensing the predetermined upper limit of the valve and for causing said extensible thrust conveying means to collapse completely during the second mode whenever the valve attains this predetermined upper limit, whereby the valve may be selectively opened when the valve train is engaged by the primary base circle of the rotating cam without increasing the valve lift caused by the raised portion of the rotating cam to thereby insure proper valve piston clearance during all modes of operation.

2. A control apparatus as defined in claim 1, wherein said extensible thrust conveying means further includes a pair of telescopically engaged thrust members which are biased toward extension and are configured to form a variable volume chamber, said thrust members containing a fluid inlet and a fluid outlet communicating with said variable volume chamber and adapted to be connected with a source of non-compressible fluid and a fluid sump, respectively.

3. A control apparatus as defined in claim 2, wherein said control means further includes (a) check valve means connected with said thrust members for permitting non-compressible fluid to flow into said variable volume chamber while at all times preventing reverse flow of fluid through said fluid inlet, and (b) control valve means connected with said thrust members and movable between a first position in which fluid is prevented from flowing into said variable volume chamber through said fluid inlet but is permitted to flow out of said variable volume chamber through said fluid outlet to cause expansion and collapse of said thrust members during rotation of the cam and a second position in which said fluid inlet is open to allow fluid flow into said variable volume chamber through said check valve means and said fluid outlet is blocked to prevent fluid flow out of said variable volume chamber through said fluid outlet whereby thrust members extend and collapse when said control valve means is in said first position.

4. A control apparatus as defined in claim 3, wherein said position sensing means includes a pressure relief outlet contained within said thrust members communicating with said variable volume chamber and positioned to register with a pressure relief port contained within the internal combustion engine and communicating with the noncompressible fluid sump when the valve approaches the predetermined upper limit.

5. Control apparatus as defined in claim 3, wherein said control valve means includes a passageway contained in one of said thrust members and communicating with said fluid inlet, said fluid outlet and with an outside source of control fluid, said control valve means further includes a slide valve plunger biased toward a first position blocking said fluid inlet but leaving said fluid outlet unblocked and movable to a second position when subjected to control fluid pressure blocking said fluid outlet but leaving said fluid inlet unblocked.

6. Control apparatus as defined in claim 5, wherein the control fluid and the non-compressible fluid is the same.

7. A method for insuring mechanical clearance between the piston head and valve of an internal combustion engine having at least one reciprocating piston and an associated valve operable in selectively variable timed relationship with the piston by means of a valve train connected with a rotatable cam including a primary base circle for closing the valve, a raised portion for opening the valve to a predetermined upper limit and a secondary base circle recessed below the primary base circle for successively engaging the valve train during cam rotation, comprising the steps of (a) providing an extensible thrust conveying member in the valve train adapted to expand when the portion of the cam engaging the valve train shifts from the raised portion to the secondary base circle and normally to collapse when the portion of the cam engaging the valve train shifts from the secondary base circle to the primary base circle during each revolution of the cam;

(b) selectively switching to a braking mode of operating the extendible thrust conveying member by locking the extensible thrust conveying member in the expanded position when the valve train is engaged with the secondary base circle of the rotating cam;

(c) maintaining the locked condition during the braking mode when the valve train is engaged by the primary base circle of the rotating cam to prevent normal collapse of the extensible thrust conveying member; and (d) collapsing fully the extensible thrust conveying members just prior to the valve train engaging the outermost portion of the raised portion of the cam during the braking mode.

8. An extensible and collapsible valve control apparatus for use in an internal combustion engine having a reciprocating piston, at least one associated valve operated by a valve train for opening and closing the valve in timed relationship with the piston strokes, and a profiled cam engaging the valve train designed to permit selective variation in the timed relationship wherein the cam profile includes a raised portion for opening the valve to a predetermined upper limit, a primary base circle for closing the valve and a secondary base circle located on the cam so as to engage the valve train prior to the engagement of the valve train by the primary base circle, the secondary base circle being recessed below the radius of the primary base circle, said valve control apparatus comprising (a) extensible thrust conveying means installable within the valve train to convey opening and closing movement from the cam to the valve, said extensible thrust conveying means including a pair of telescopically engaged thrust members which are biased toward extension and which are shaped to form a variable volume chamber and to collapse to a predetermined length sufficiently short to permit closing of the valve when the primary base circle of the cam engages the valve train but sufficiently long to permit full opening of the valve when the raised portion of the cam engages the valve train, said thrust members containing a fluid inlet and a fluid outlet communicating with said variable volume chamber and adapted to be connected with a source of non-compressible fluid and a fluid sump, respectively;

(b) check valve means connected with said thrust members for permitting non-compressible fluid to flow into said variable volume chamber while at all times preventing reverse flow of fluid through said fluid inlet;

(c) control valve means connected with said thrust members and movable between a first position in which fluid is prevented from flowing into said variable volume chamber through said fluid inlet but is permitted to flow out of said variable volume chamber through said fluid outlet to cause expansion and collapse of said thrust members during rotation of the cam and a second position in which said fluid inlet is open to allow fluid flow into said variable volume chamber through said check valve means and said fluid outlet is blocked to prevent fluid flow out of said variable volume chamber through said fluid outlet, whereby said thrust members extend and collapse when said control valve means is in said first position to provide a first predetermined timed relationship between the valve and piston movements and said thrust members extend and are held in the extended position to provide a second predetermined timed relationship between the valve and piston movements; and (d) a position sensing means for sensing the predetermined upper limit of the valve and for causing said extensible thrust conveying means to collapse completely during the second mode whenever the valve attains this predetermined upper limit, whereby the valve may be selectively opened when the valve train is engaged by the primary base circle of the rotating cam without increasing the valve lift caused by the raised portion of the rotating cam to thereby insure proper valve piston clearance during all modes of operation.

9. Valve control apparatus as defined in claim 8, wherein said control valve means includes a passageway contained in one of said thrust members, said passageway communicating with said fluid inlet, said fluid outlet and with an outside source of control fluid, said control valve means further includes a slide valve plunger biased toward a first position blocking said fluid inlet but leaving said fluid outlet unblocked and movable to a second position when subjected to control fluid pressure sufficient to overcome the bias of said slide valve toward said first position.

* * * * *